US007254919B2

(12) United States Patent
Lutz et al.

(10) Patent No.: US 7,254,919 B2
(45) Date of Patent: Aug. 14, 2007

(54) TRUSS ANCHOR

(75) Inventors: Robert W. Lutz, Tampa, FL (US); John W. Schmidt, III, Palm Harbor, FL (US)

(73) Assignee: United Steel Products Company, Montgomery, MN (US)

( * ) Notice: Subject to any disclaimer, the term of this patent is extended or adjusted under 35 U.S.C. 154(b) by 209 days.

(21) Appl. No.: 10/685,765

(22) Filed: Oct. 14, 2003

(65) Prior Publication Data

US 2005/0011157 A1 Jan. 20, 2005

Related U.S. Application Data

(60) Provisional application No. 60/487,632, filed on Jul. 16, 2003.

(51) Int. Cl.
*E04B 1/41* (2006.01)
*E04B 1/38* (2006.01)

(52) U.S. Cl. ..... 52/92.2; 52/93.2; 52/712; 52/715; 52/699

(58) Field of Classification Search ..... 52/712, 52/715, 295, 91.1, 91.2, 665, 90.1, 714, 698, 52/93.2, 92.2, 699
See application file for complete search history.

(56) References Cited

U.S. PATENT DOCUMENTS

| | | | | | |
|---|---|---|---|---|---|
| 2,110,863 | A * | 3/1938 | Barnett | 52/101 |
| 2,191,979 | A * | 2/1940 | Bierbach | 52/370 |
| 2,467,115 | A * | 4/1949 | Duggan | 52/699 |
| 2,947,119 | A * | 8/1960 | Puckett, Jr. | 52/699 |
| 3,000,145 | A * | 9/1961 | Fine | 52/699 |
| 3,256,030 | A * | 6/1966 | Banse | 403/400 |
| 4,329,826 | A * | 5/1982 | Flogaus et al. | 52/712 |
| 4,404,781 | A * | 9/1983 | Gilb | 52/295 |
| 4,410,294 | A * | 10/1983 | Gilb et al. | 403/27 |
| 4,449,335 | A * | 5/1984 | Fahey | 52/92.2 |
| 4,572,695 | A * | 2/1986 | Gilb | 403/232.1 |
| 4,920,725 | A * | 5/1990 | Gore | 52/702 |
| 5,109,646 | A * | 5/1992 | Colonias et al. | 52/712 |
| 5,307,603 | A * | 5/1994 | Chiodo | 52/698 |
| 5,564,248 | A * | 10/1996 | Callies | 52/702 |
| 5,813,182 | A * | 9/1998 | Commins | 52/295 |
| 6,560,943 | B1 * | 5/2003 | Leek et al. | 52/715 |
| 6,662,517 | B1 * | 12/2003 | Thompson | 52/714 |

* cited by examiner

*Primary Examiner*—Robert Canfield
(74) *Attorney, Agent, or Firm*—David E. Bruhn

(57) ABSTRACT

A unitary, one-piece anchor for connecting a roof truss or other building structural member to a cementitious wall to resist uplift and lateral forces.

15 Claims, 5 Drawing Sheets

46
14
45
45
44
44
42
37
41
36
40
40
39
39
36
33
33
32
32
18
31
31
13
24
30
12
11
24
5
5
29
25
25
21
26
22
26
30

14
36
36
38
UP 87°±1°
UP 87°±1°
38
DWN 89°±1°
DWN 89°±1°
33
33
32
32
31
31
24
13
18
11
12
11
12
24
30
30
25
30
25
A
30
19
20

TRUSS ANCHOR

This application claims the benefit of Provisional Application Ser. No. 60/487,632, filed Jul. 16, 2003.

BACKGROUND OF THE INVENTION

1. Field of the Invention

The present invention relates to an anchor for securing a building member such as a roof truss or other structural building member to a cementitious material such as a cementitious wall, and more particularly to a unitary, one piece truss anchor and a building structure incorporating such truss anchor.

2. Description of the Prior Art

A wide variety of truss anchors currently exists in the art. Many of these are made of relatively light-weight metals with a two-piece construction comprising a generally elongated strap and a structural member seat which is riveted to the strap. In these structures, the lower end of the strap is designed for embedment into the concrete at the top of a wall and the upper end of the strap is intended to extend upwardly along the side of the truss and wrap over the top. Some are one-piece connectors. One of these has a plurality of offset anchoring legs embedded in the wall. Representative truss anchors for anchoring a roof truss or other structure to a concrete or masonry wall include U.S. Pat. No. 2,467,115 issued to Dugan, U.S. Pat. No. 2,947,119 issued to Puckett Jr., U.S. Pat. No. 5,307,603 issued to Chiodo and U.S. Pat. No. 6,560,943 issued to Leek.

Truss anchors of the type to which the present invention relates serve two primary functions. One is to provide a resistance to uplift which is of particular concern throughout many southern states where hurricanes and other high wind conditions are common. A second is to provide resistance to lateral forces, both lateral forces parallel to the wall and lateral forces perpendicular to the wall. Because many new homes and other structures are being built with relatively long truss spans, greater resistance to uplift and lateral forces is required.

Accordingly, there is a need in the art for a truss anchor which can meet these requirements.

SUMMARY OF THE INVENTION

The truss anchor of the present invention is preferably a one-piece structure which is cut from a single sheet of metal. The preferred structure of the anchor of the present invention includes an anchoring leg portion having a pair of spaced anchoring legs which are embedded into the cementitious wall or other cementitious material and a relatively low profile, co-planar connecting portion designed for connection to the supported truss or other building member. The pair of spaced legs include improved means in the form of pull-out resistance flanges and tabs to retain the legs in the cementitious material and to resist pull-out and lift forces. In a roof truss anchor application, the anchoring leg portion further includes a pair of guide ramps for guiding and positioning the truss anchor relative to a cement block wall to ensure self-centering of the anchor relative to the block.

The truss anchor of the preferred embodiment of the present invention also includes a pair of structural member support seats extending outwardly from and integrally formed with upper edges of the anchoring leg portion. These seats are spaced from one another and include upturned flanged ends to assist in supporting and retaining the supported truss relative to the truss anchor.

Accordingly, it is an object of the present invention to provide an anchor for connecting a building structural member to a cementitious material which provides improved resistance to uplift and lateral forces.

Another object of the present invention to provide an improved one-piece truss anchor for anchoring a roof truss or other structural member to a cementitious wall.

Another object of the present invention is to provide a truss anchor having one or more embedded anchoring legs with improved pull-out and lateral force resistance.

A further object of the present invention is to provide a truss anchor with improved lift and lateral force resistance.

A still further object of the present invention is to provide a truss anchor with a pair of truss support seats integrally formed with and extending from the anchoring leg portion.

These and other objects of the present invention will become apparent with reference to the drawings, the description of the preferred embodiment and the appended claims.

DESCRIPTION OF THE PREFERRED EMBODIMENT

Figure 1:
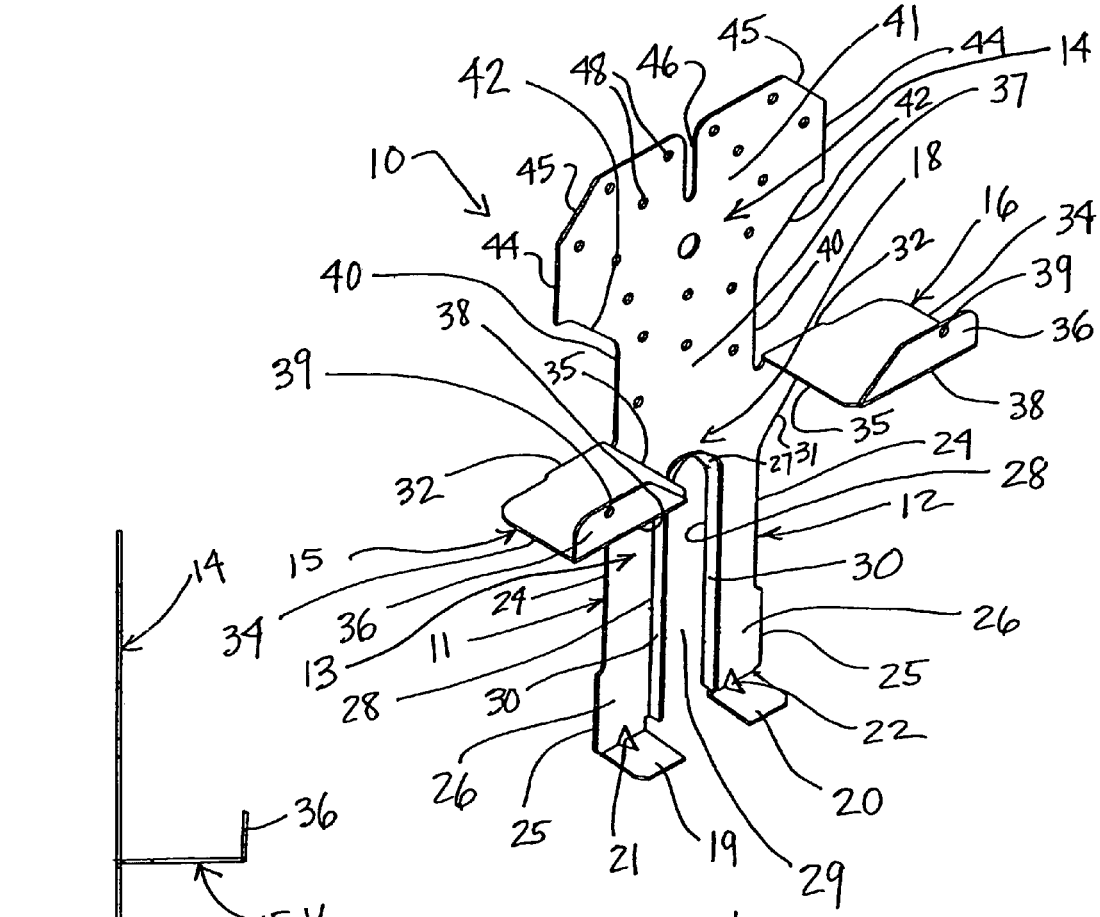
FIG. 1 is an isometric view of the truss anchor of the present invention.
Figure 3:
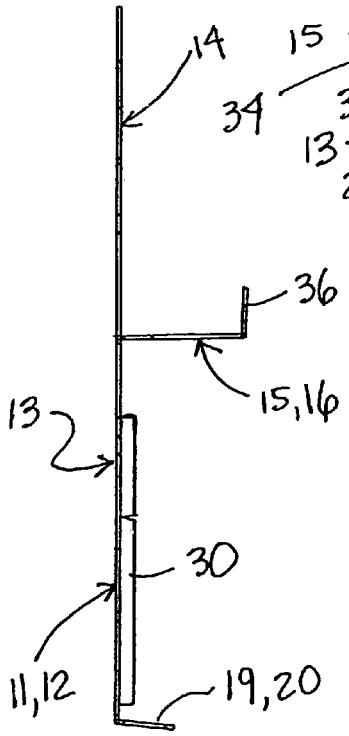
FIG. 3 is an elevational side view of the truss anchor of the present invention.
Figure 4:
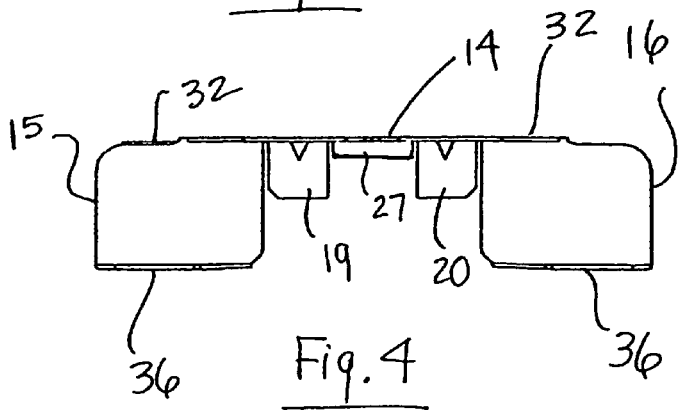
FIG. 4 is an elevational top view of the truss anchor of the present invention.

The present invention relates to an anchor for connecting a building structural member to a cementitious material. Although features of the invention have applicability to various anchors such as mudsill or foundation anchors for connecting a building structural member to concrete, it has particular application as a truss anchor which is designed to attach a roof truss or other building structure to a cementitious or masonry wall. As used herein, the term "cementitious" shall include, among other things, cement, concrete, mortar, grout, or the like, and the term "cementitious wall" shall include, among other things, walls constructed of poured concrete, walls constructed of cement blocks, or the like. Generally, a truss comprises a pair of rafters and a tie or other structure connecting the rafters near their base ends. The truss anchor of the present invention can, however, be used to anchor rafters or other building members without a tie. Preferably, the truss anchor of the present invention is used to connect a roof truss to the top of a concrete, or other cementitious masonry wall to resist uplift and lateral forces (both parallel and perpendicular to the wall).

With initial reference to FIGS. 1-4, the truss anchor 10 of the preferred embodiment of the present invention is a unitary, one-piece structure which includes an embedment or anchoring leg portion 13 comprising a pair of spaced apart anchoring legs 11 and 12 and an upper section 18. A connection or truss connection portion 14 is generally coplanar with the legs 11 and 12 and the section 14 and is integrally joined with the anchoring leg portion 13 via the upper section 18. A spaced apart pair of truss support seats 15 and 16 extend outwardly from top edges of the section 18. During use, the embedment or anchoring leg portion 13 (the legs 11, 12 and the section 18) is designed and intended to be embedded in the cementitious material of the wall and the truss connection portion 14 is designed and intended to extend above the wall and to be connected with the roof truss or other structural member.

As shown, each of the legs 11 and 12 includes an upper end integrally formed with the upper section 18 and a lower end which terminates in a forwardly extending foot 19 and 20, respectively. As shown best in FIGS. 1 and 3, each foot 19 and 20 is bent forwardly from the generally planar legs 11 and 12 at approximately right angles. In the preferred embodiment, the angle which the feet 19 and 20 form with their respective legs 11 and 12 may vary between 90° and 100°. A pair of stiffener knees 21 and 22 are provided between the legs 11, 12 and their respective feet 19, 20 to prevent the legs from being pulled out of the concrete, thereby providing increased resistance to uplift and lateral forces. The feet 19, 20 additionally prevent the anchor from sinking into the grout or rotating out of plane after it is set.

Each of the legs 11 and 12 is provided with first and second side edges. One of these side edges is defined by an outer side edge 24 which extends from the upper section 18 toward the feet 19 and 20. A portion 25 of the outer edge 24 extends laterally outwardly to provide a portion 26 of the legs 11 and 12 which is wider than the remaining portion. In the preferred embodiment, this wider portion 26 is located at or near the lower end of the legs 11 and 12 to assist in preventing the legs 11 and 12 from being pulled out of the concrete and thus providing resistance to uplift and lateral forces. Accordingly, each of the legs 11 and 12 includes a narrower section generally toward the upper end of the legs and a wider section generally toward the lower end of the legs. The wider section has a lateral width dimension greater than the lateral width dimension of the narrower section.

The other of the first and second side edges of each of the legs 11 and 12 includes an inner side edge 28. These edges 28 extend generally parallel to one another and are spaced from one another to define a central crotch or opening 29. As will be described in greater detail below with reference to FIG. 9, the width of the opening 29 (between the inner edges 28,28) is sufficiently wide to accommodate a number 7 reinforcing bar. In a wall constructed of U blocks, a number 7 reinforcing bar is often provided along the center of the U block to tie the blocks together. Accordingly, in the preferred embodiment, the width of the opening 29 is at least about 1 inch. As will also be further discussed below with reference to FIG. 9, the width of the legs 11 and 12 is selected, relative to the width of the opening 29 and the width of the U block center opening, to accommodate a number 5 reinforcing bar on the outer side of each of the legs 11 and 12. In general, the width of the legs 11 and 12 is approximately ¾ to 1 inch.

Figures 2, 5, 6:
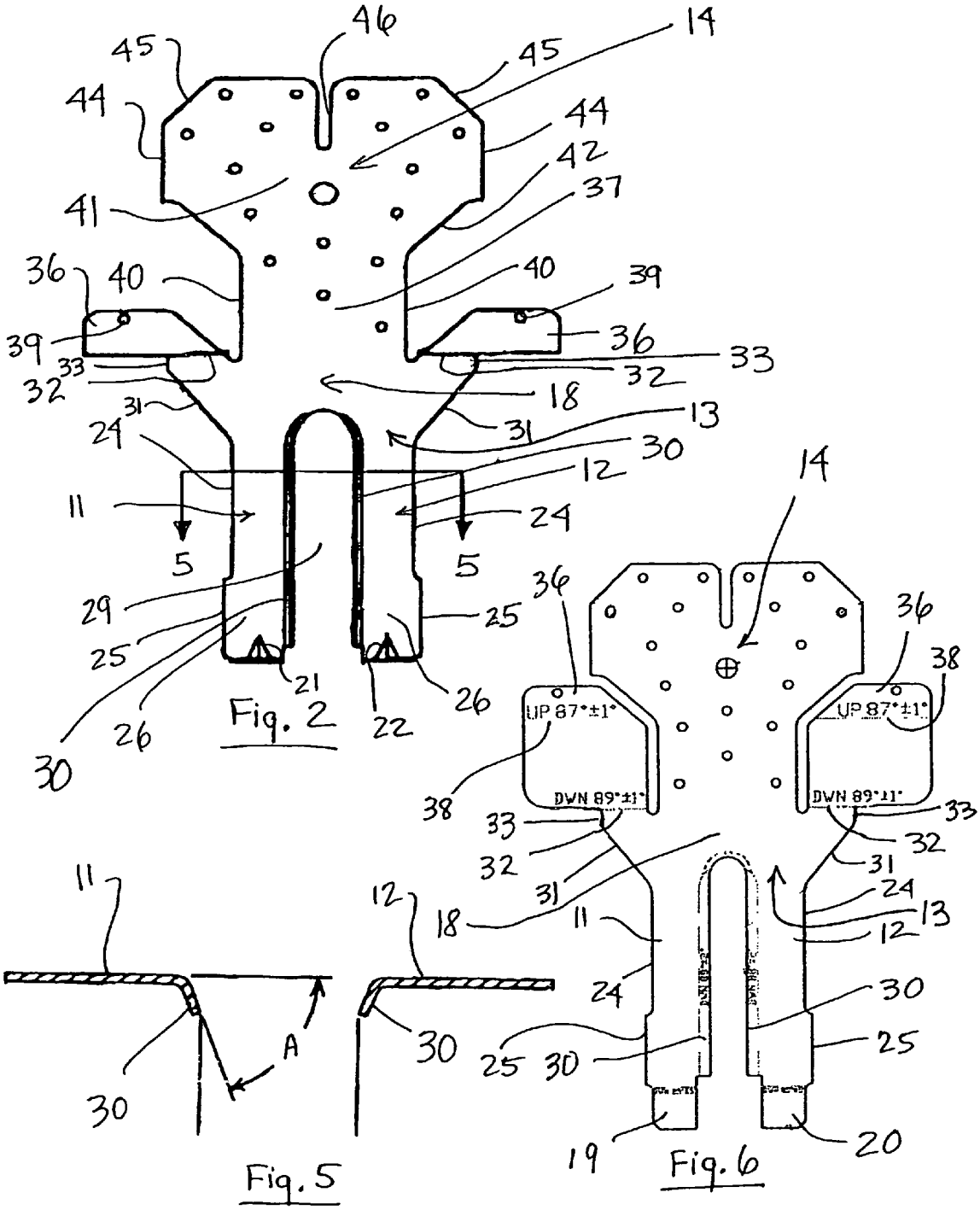
FIG. 2 is an elevational front view of the truss anchor of the present invention.
FIG. 5 is a view, partially in section, as viewed along the section line 5-5 of FIG. 2.
FIG. 6 is an elevational view of the cut out planar blank from which the truss anchor of the present invention is formed.

Each of the legs 11 and 12 also includes a flange 30,30 extending outwardly from the inner side edges 28 of the legs. As shown in FIG. 5, these flanges extend outwardly at an angle "A" of approximately 80° to 95° from the legs 11 and 12. These flanges 30 extend from near the upper end of the opening 29 to the lower end of the opening 29. With this location of the flanges 30, the entirety of the flanges 30, and in particular the upper end of the flanges 30 is totally embedded in the concrete or cementitious material, thereby providing additional pull-out and lateral force resistance. In the preferred embodiment, an outwardly extending flange 27 is provided at the upper end of the opening 29.

Although the preferred embodiment shows the embedment or anchoring leg portion as including a pair of anchoring legs 11 and 12, any number of anchoring legs may be provided. For example, a truss anchor in accordance with the present invention that includes a single leg (or more than two legs) will function acceptably in many applications. Accordingly, the anchoring leg portion should preferably include at least one anchoring leg.

The upper section 18 of the anchoring leg portion is generally coplanar with the legs 11 and 12 and includes outer side edges 31,31 which slope upwardly and laterally outwardly from the upper ends of the legs 11 and 12 toward the outer ends of top edges 32,32. These sloping edges 31,31 provide the truss anchor of the present invention with a self-centering feature relative to a conventional U block or other cement block. Each of the side edges terminates at a vertical edge 33,33 to accommodate blocks of varying widths, such as blocks with a center opening slightly narrower than a conventional block. Specifically, the lateral or width dimension of the upper section 18 at the top of the sloping surfaces 31,31 (i.e., between the vertical legs 33,33) is approximately equal to or less than the internal dimension of a conventional U or other cement block. During installation, the sloping edges 31,31 contact the inner edges of the block, thereby causing the truss anchor to be centered within the upper opening of the block.

The upper section 18 of the anchoring leg portion further includes a central section which is integrally joined with and coplanar with the truss connection portion 14. Outer sections on each side of this central section include and are defined by the sloping edges 31,31, the top edges 32,32 and the vertical edges 33,33. The top edges 32,32 are collinear with one another and are integrally formed with the pair of seats 15 and 16. Specifically, the seats 15 and 16 are formed by bending the seat material forwardly and outwardly along the edges 32,32 to form the pair of seat members 15 and 16.

Each of the seat members 15 and 16 includes a lateral outer edge 34 and a lateral inner edge 35. The respective inner edges 35,35 are spaced from one another as shown. In the preferred embodiment, the spacing between the inner edges 35,35 approximates the spacing between the outer edges 24,24 of the legs 11 and 12.

Each of the seats 15 and 16 also includes a generally flat, planar surface for supporting the roof truss. When installed, the seats 15 and 16 are intended to be at or slightly above the top of the wall. This enables the seat members 15 and 16 to provide a moisture barrier and keep the truss off the concrete. Each seat 15 and 16 also includes a truss connection flange 36 along its distal or outer edge 38. These flanges 36,36 are bent upwardly along the outer edges 38 of the seats 15 and 16 and include a connection opening 39. This connection opening 39 permits the connection flanges 36 to be connected with a portion of the roof truss via nails, screws or other fastening means and to hold the truss firmly in place while driving nails into the truss through the holes 48 in the top 41 and neck sections 37 as described below. The dimension of the seats 15 and 16 between the top edges 32 and the connection flanges 36 is sufficient to accommodate a standard roof truss.

The truss connection portion 14 is substantially planar and includes a neck section 37 defined by the side edges 40,40. The neck section is coplanar with and integrally connected with the central portion of the upper section 18. The truss connection portion 14 also includes a wider head portion 41 defined by the edge portions 42, 44 and 45. The head section 41 is coplanar with and integrally formed with the neck section 37 and has a maximum lateral width dimension which is preferably at least 25% wider than the lateral width dimension of the neck section 37. More preferably, the lateral width dimension of the head section 41 is at least 50% wider than the lateral width dimension of the neck section 37. The upper, central area of the section 41 is split by the slot 46. This permits one half or a portion of the section 41 to be bent over an upper member of the truss in the event the truss anchor is used to connect a relatively low profile roof such as a truss built with 2×4s.

The truss connection portion 14 is provided with a plurality of connection openings 48 throughout the neck section 37 and the head section 41. This permits the truss connection portion 14 to be connected to the side surface of a roof truss or other supporting structure by a plurality of screws, nails or other fastening means.

Figure 7:
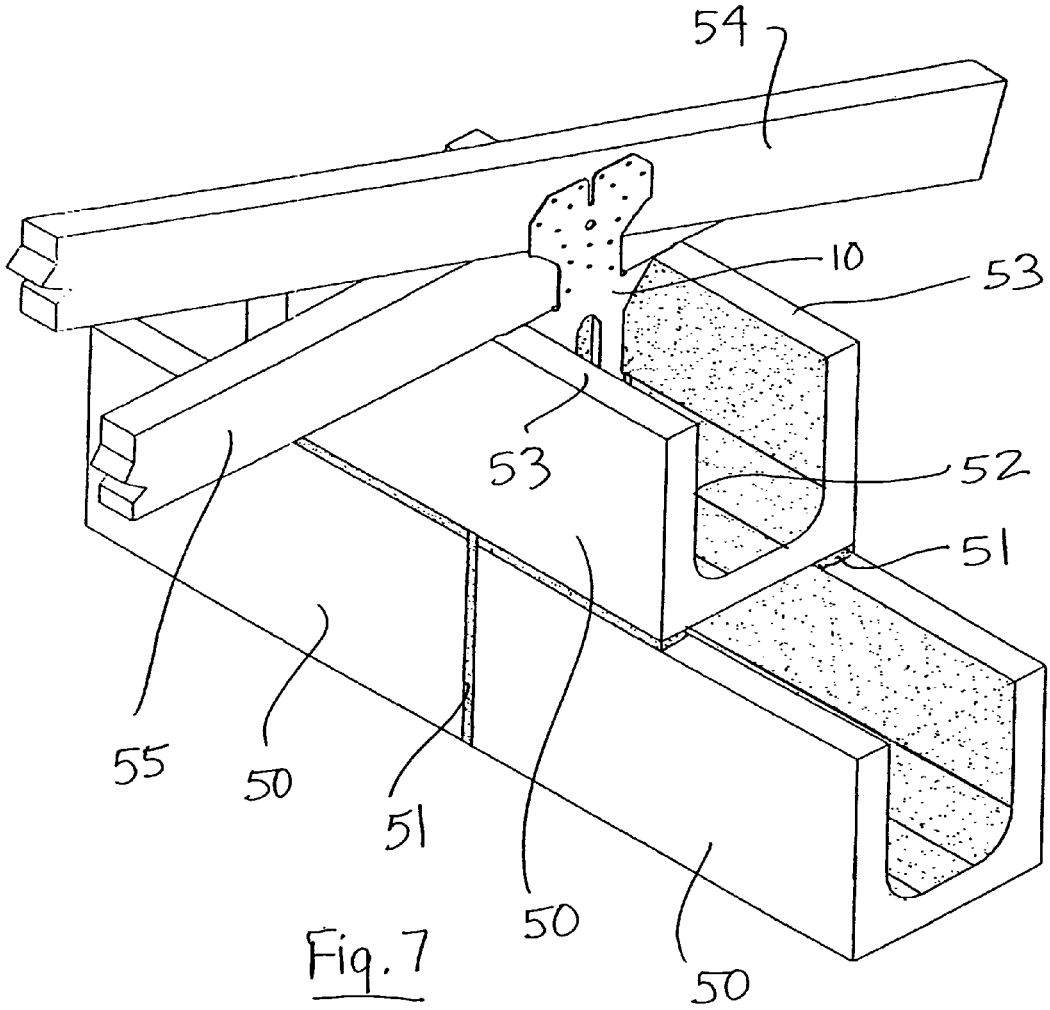
FIG. 7 is an isometric view showing the truss anchor of the present invention connecting a roof truss to a cement U block before filling the top opening of the U block with concrete.
Figure 8:
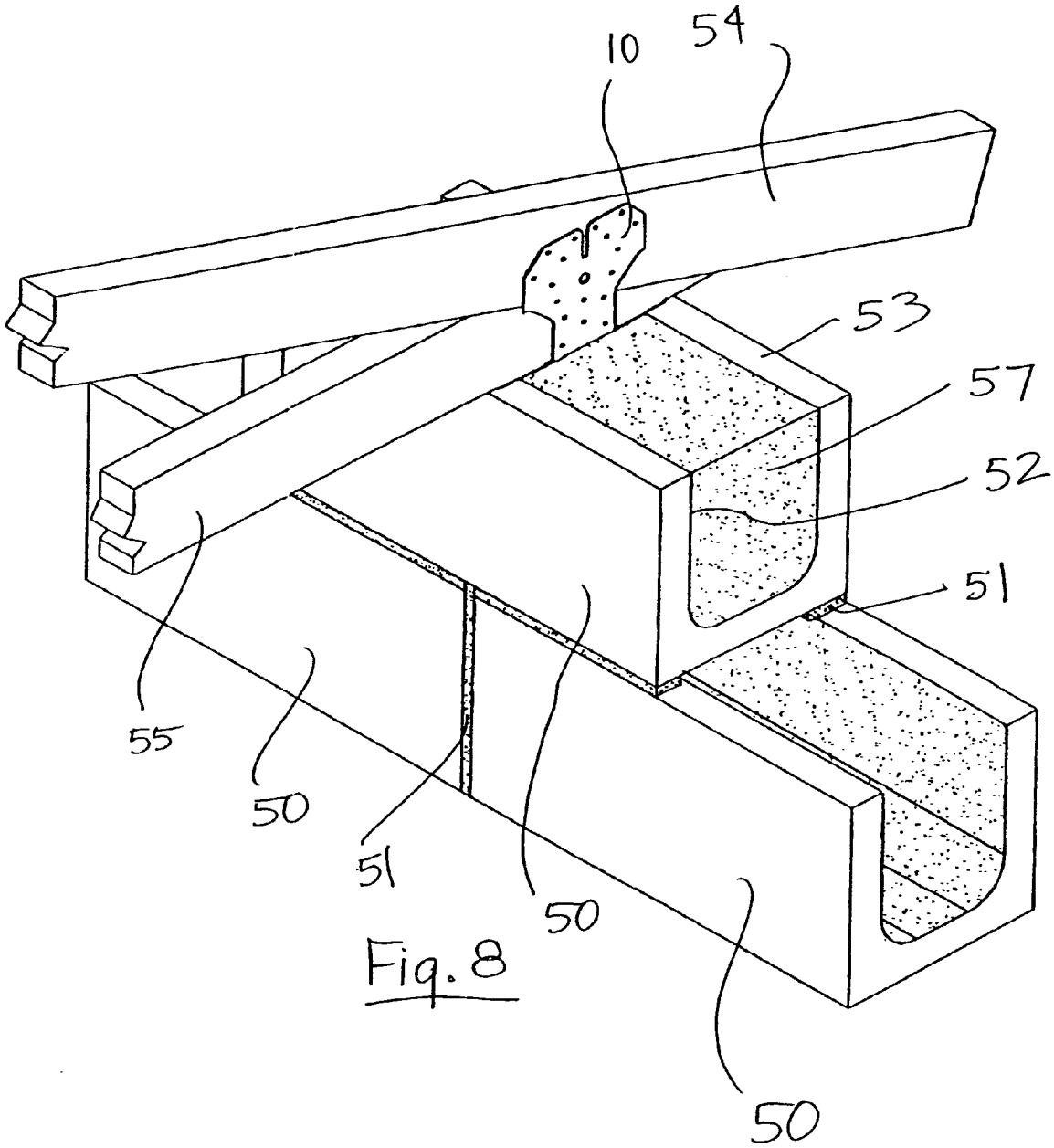
FIG. 8 is a view, similar to FIG. 7, with the top opening of the U block filled with concrete.
Figure 9:
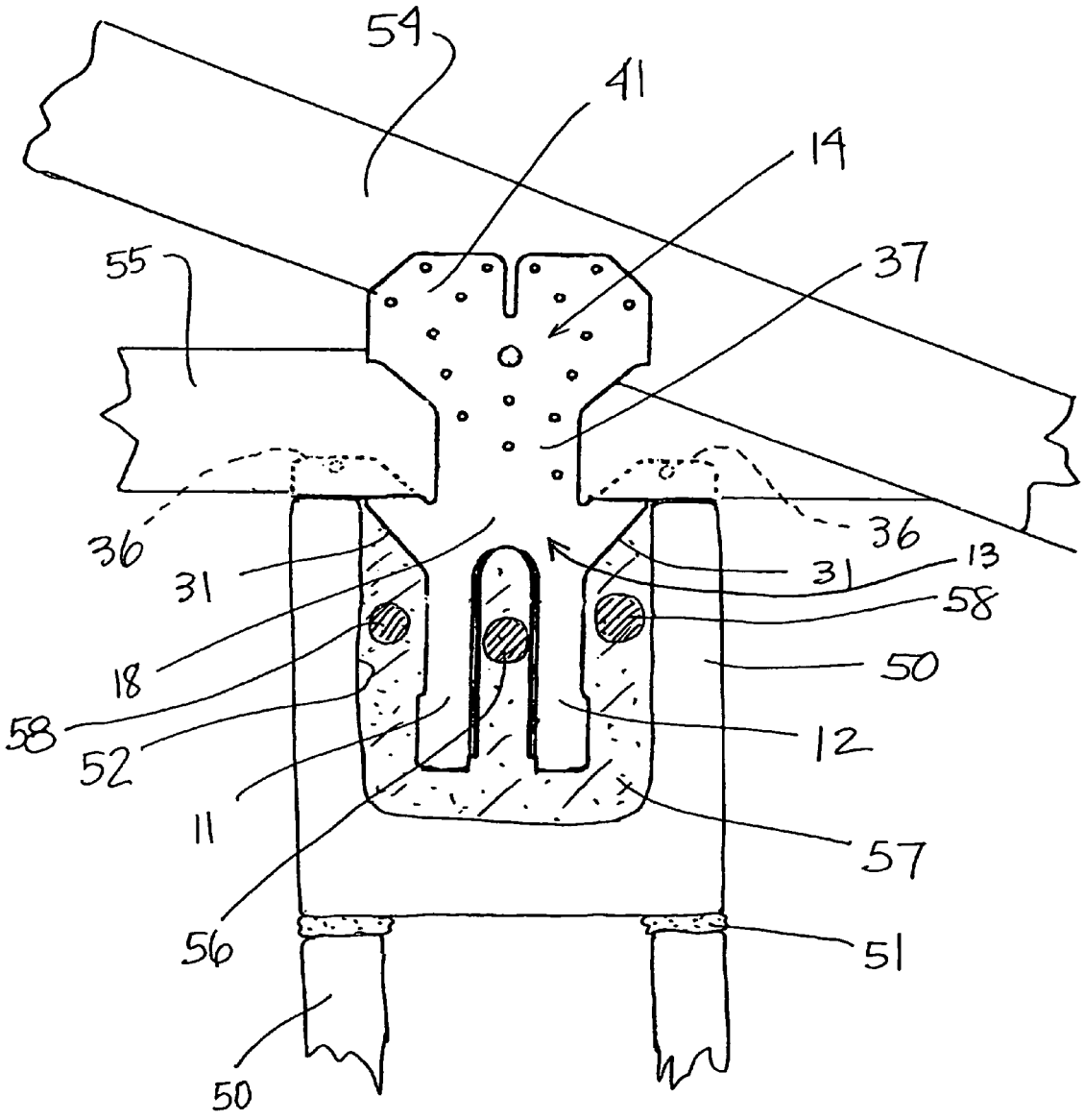
FIG. 9 is a view, partially in section, showing a truss anchor of the present invention embedded into a cement U block.

FIGS. 7, 8 and 9 show the truss anchor of the present invention as used with a U block wall to support a roof truss. Specifically, the block wall is comprised of a plurality of U blocks 50 which are connected to one another by mortar 51 in a conventional manner. Each of the blocks 50 includes a generally U-shaped top opening 52. FIGS. 7, 8 and 9 also show a portion of a roof truss supported by the truss anchor 10 on top of the upper row of blocks 50, although multiple courses of blocks are not required. The roof truss includes a rafter 54 and a tie 55 connected with the rafter near its outer end. When fully installed, the upper section 18 and the legs 11 and 12 of the anchoring leg portion (FIGS. 1 and 2) are embedded in the grout or cement 57 (FIGS. 8 and 9) in the U-shaped opening 52 in the top row of blocks 50. As shown best in FIG. 9, the seats 15 and 16 are positioned approximately at the top edges of the U block to support the bottom edge of the tie member 55. When so installed, the sloping surfaces 31,31 assist in centering the truss anchor relative to the U-shaped opening 52.

With continuing reference to FIG. 9, the position and dimensions of the legs 11 and 12 is sufficient to accommodate a variety of combinations of reinforcing bars within the U-shaped channel 52. Specifically, the dimensions of the legs 11 and 12 are designed to accommodate a number 7 reinforcing bar 56 between the legs 11 and 12 or a pair of number 5 reinforcing bars 58,58 between the outer edges of the legs 11 and 12 and the inner surfaces of the U-shaped opening 52.

Although the truss anchor of the present invention can be constructed from a variety of materials with a variety of thicknesses, the preferred embodiment contemplates the truss anchor being constructed of galvanized steel with a thickness of at least 18 gauge.

In the preferred embodiment, the truss anchor of the present invention is of unitary or one-piece construction and is stamped or cut from a single piece of material in the form of the truss anchor blank shown in FIG. 6. In FIG. 6, the reference characters for the elements of the finished product shown in FIGS. 1 and 2 are reflected on the drawing of the blank.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

The invention claimed is:

1. An anchor for connecting a building structural member to a cementitious material comprising:

a connection portion designed for connection to the building structural member above the cementitious material;

an embedment portion integrally joined with and coplanar with said connection portion and designed for embedment in said cementitious material, said embedment portion including at least one anchoring leg having an upper end and a lower free end, said at least one anchoring leg having first and second leg sections, said first leg section located closer to said upper end than said second leg section and said second leg section located closer to said free end than said first leg section, said second leg section having a width dimension greater than said first leg section; and first and second laterally spaced supporting seat members integrally joined with said embedment portion along respective first and second bend lines wherein at least a portion of said embedment portion lies directly below each of said seat members.

2. The anchor of claim 1 including a pair of laterally spaced anchoring legs, each having first and second leg sections, said first leg section located closer to said upper end than said second leg section and said second leg section located closer to said free end than said first leg section, said second leg section having a width dimension greater than said first leg section.

3. The anchor of claim 1 wherein said first and second bend lines are substantially collinear.

4. An anchor of for connecting a building structural member to a cementitious material comprising:

a connection portion designed for connection to the building structural member above the cementitious material;

an embedment portion integrally joined with and coplanar with said connection portion and designed for embedment in said cementitious material, said embedment portion including a pair of anchoring legs having an upper end and a lower free end, each of said anchoring legs having first and second leg sections, said first leg section located closer to said upper end than said second leg section and said second leg section located closer to said free end than said first leg section, said second leg section having a width dimension greater than said first leg section wherein each of said pair of anchoring legs includes an inner edge and a flange extending from said inner edge; and first and second laterally spaced supporting seat members integrally joined with said embedment portion along respective first and second bend lines.

5. The anchor of claim 4 wherein each of said pair of anchoring legs includes a foot member at said free end.

6. An anchor for connecting a building structural member to a cementitious material comprising:

a connection portion designed for connection to the building structural member above the cementitious material;

an embedment portion integrally joined with and coplanar with said connection portion and designed for embedment in said cementitious material, said embedment portion including at least one anchoring leg having an upper end and a lower free end, said at least one anchoring leg having first and second leg sections, said first leg section located closer to said upper end than said second leg section and said second leg section located closer to said free end than said first leg section, said second leg section having a width dimension greater than said first leg section; and first and second supporting seat members each having a supporting seat for supporting said building structural member and each including an outer, upwardly extending connection flange and a connection opening in said connection flange.

7. The anchor of claim 6 wherein said connection portion includes first and second head sections defined by a split in said connection portion to enable said first and second head sections to be independently bent.

8. An anchor for connecting a building structural member to a cementitious material comprising:

a connection portion designed for connection to the building structural member above the cementitious material;

an embedment portion joined with and coplanar with said connection portion and designed for embedment in said cementitious material, said embedment portion including at least one anchoring leg having an upper end and a lower free end; and first and second supporting seat members each having a supporting seat, said first and second seat members being laterally spaced from one another and joined to said embedment portion along respective first and second laterally extending and collinear bend lines wherein at least a portion of said embedment portion lies directly below each of said seat members.

9. A truss anchor for connecting a building structural member to a cementitious material comprising:

a connection portion designed for connection to the building structural member above the cementitious material;

an embedment portion joined with said connection portion and designed for embedment in said cementitious material, said embedment portion including at least one anchoring leg having an upper end and a lower free end; and first and second supporting seat members each having a supporting seat, said first and second seat members being laterally spaced from one another and joined along respective first and second connection edges to said embedment portion wherein each of said supporting seats includes an outer, upwardly extending connection flange and a connection opening in said connection flange.

10. An anchor for connecting a building structural member to a cementitious material comprising:

a connection portion designed for connection to the building structural member above the cementitious material;

an embedment portion joined with said connection portion and designed for embedment in said cementitious material, said embedment portion including at least one anchoring leg having an upper end and a lower free end and wherein said embedment portion includes a sloping side edge sloping upwardly and laterally outwardly from the upper end of said at least one anchoring leg; and first and second supporting seat members each having a supporting seat, said first and second seat members being laterally spaced from one another and joined to said embedment portion along respective first and second laterally extending and collinear bend lines.

11. A building structure comprising:

a cementitious material;

a building structural member; and an anchor having a connection portion connected to said building structural member, an embedment portion joined with and coplanar with said connection portion and embedded in said cementitious material, and first and second supporting seat members each having a supporting seat for supporting said building structural member, said first and second seat members being laterally spaced from one another and joined along respective first and second laterally extending and collinear bend lines to said embedment portion wherein at least a portion of said embedment portion lies directly below each of said seat members.

12. The building structure of claim 11 wherein said cementitious material is a cementitious wall which includes a top opening to receive cementitious material and a pair of top wall edges on opposite sides of said top opening.

13. The building structure of claim 12 wherein said first and second supporting seats members are located at or above the top of said cementitious material.

14. An anchor for connecting a building structural member to a cementitious material comprising:

a connection portion for connection to the building structural member;

an embedment portion joined with and coplanar with said connection portion for embedment in said cementitious material and including a central anchoring portion; and first and second seat members positioned on opposite lateral sides of said anchoring portion wherein said embedment portion includes first and second side portions integrally connected with said first and second supporting seat members along first and second respective bend lines wherein at least a portion of said embedment portion lies directly below each of said seat members.

15. The anchor of claim 14 wherein said first and second bend lines are substantially collinear.

* * * * *